United States Patent [19]

Mulock-Bentley

[11] Patent Number: 4,488,593

[45] Date of Patent: Dec. 18, 1984

[54] HEAT EXCHANGER

[75] Inventor: Desmond Mulock-Bentley, Illovo, South Africa

[73] Assignee: D. Mulock-Bentley and Associates (Proprietary) Limited, South Africa

[21] Appl. No.: 416,471

[22] Filed: Sep. 10, 1982

[51] Int. Cl.[3] ..... F28D 1/04

[52] U.S. Cl. ..... 165/151; 165/152; 165/182; 29/157.3 B

[58] Field of Search ..... 165/151, 153, 182, 148, 165/152

[56] References Cited

U.S. PATENT DOCUMENTS

| | | |
|---|---|---|
| 824,492 | 6/1906 | Livingston . |
| 1,239,496 | 9/1917 | Livingston . |
| 1,314,263 | 8/1919 | Harrison . |
| 1,893,521 | 1/1933 | Modine . |
| 1,950,500 | 3/1934 | Loprich et al. . |
| 3,818,568 | 6/1974 | Sennstrom . |
| 4,332,291 | 6/1982 | Mulock-Bentley . |

FOREIGN PATENT DOCUMENTS

| | | |
|---|---|---|
| 711655 | 7/1968 | Belgium . |
| 976523 | 3/1956 | Fed. Rep. of Germany . |
| 2620706 | 11/1977 | Fed. Rep. of Germany . |
| 1173128 | 10/1958 | France . |
| 1527065 | 4/1968 | France . |
| 2069902 | 9/1971 | France . |
| 321270 | 4/1957 | Switzerland . |
| 1039544 | 8/1966 | United Kingdom . |

*Primary Examiner*—Albert W. Davis, Jr.

*Attorney, Agent, or Firm*—Stevens, Davis, Miller & Mosher

[57] ABSTRACT

A fin element for a heat exchanger has alternate fins A and B in parallel planes in a longitudinal central zone 10. Edge zones 12 are bent at obtuse included angles with respect to the parallel planes. The fin element is formed from a metallic strip of material by pressing the fins A and B in opposite directions and allowing the overall width of the strip to reduce so that the finished element has a constant thickness.

4 Claims, 4 Drawing Figures

HEAT EXCHANGER

FIELD OF THE INVENTION

This invention relates to heat exchangers, and in particular to a fin construction for use in heat exchangers which is suitable for use in dry cooling towers and similar industrial applications.

BACKGROUND TO THE INVENTION

U.S. Pat. No. 4,332,291 describes a heat exchanger comprising a series of conduits arranged adjacent each other but spaced apart, their external surfaces being formed with registering grooves. A set of fin elements in the form of transversely slotted metal strips is arranged in a stack between adjacent conduits with the longitudinal edges of each fin element extending into registering grooves in the opposed conduit surfaces. Each fin element has a central longitudinal zone, a transverse end zone at each end and two substantially planar longitudinal edge zones, the central longitudinal zone being planar and the edge zones each defining an obtuse included angle with the plane of the central longitudinal zone. Both edge zones lie on the same side of the plane of the central longitudinal zone.

In order for these fin elements to perform efficiently, this earlier patent describes fin elements having at one end a relatively wide transverse end zone and at the other end a relatively narrow transverse end zone. Alternate fin elements are displaced in the stack so that the slots in each fin are staggered relatively to those in its immediate neighbours but aligned with the slots in similarly positioned fin elements.

In the heat exchanger of U.S. Pat. No. 4,332,291, the creation of the slots from metal strip leads to a wastage of material since the metal stamped out of the slots is discarded. Also, the staggered pattern of alternate fin elements required for efficient heat exchange requires that the end zones of the fin elements must be distinguished and the elements correctly oriented during assembly. This adds to the already substantial labour costs inherent in assembling this type of heat exchanger.

U.S. Pat. No. 2,703,226 describes a heat exchanger with fin elements in the form of a U-shaped channel which is slit transversely at intervals along its length in its central longitudinal zone to provide a series of fins, alternate fins being struck up into the channel of the fin element. The vertically arranged side walls of channels are provided with shoulders so that the fin elements can be stacked within each other. These stacks are fixed to the opposed surfaces of adjacent conduits in a heat exchanger. One disadvantage of the fin elements described is that the presence of the vertically arranged side walls of the channel-like fin elements requires a substantial amount of metal which is largely surplus to the requirements of good heat transfer, so that the fin elements are costlier than is desirable.

The stacks disclosed in U.S. Pat. No. 2,703,226 further result in double vertical side walls, which adversely affects heat transfer.

An object of the present invention is to provide an improved heat exchanger which reduces or overcomes the disadvantages mentioned above.

SUMMARY OF THE INVENTION

According to one aspect of the invention there is provided an elongate metallic fin element for use in a heat exchanger, having a central longitudinal zone, two longitudinal edge zones and a plurality of fins each extending across the central zone and arranged side by side along the length of the central zone, alternate fins being located in two parallel planes to form two sets of fins, the thickness of the metal being substantially constant throughout the fin element.

The longitudinal edge zones of the fin elements may be each at an obtuse included angle with respect to the two parallel planes. Each fin may have planar end bridge portions in respective planes each plane being at an obtuse included angle with respect to the respect plane of that fin. The bridge portions at opposite ends of each fin may lie in planes at substantially 90° to one another.

According to another aspect of the invention there is provided a heat exchanger comprising a series of conduits spaced apart and each conduit having external surfaces provided with rows of grooves that register external surfaces of adjacent opposing surfaces, and metallic fin elements each comprising a central longitudinal zone, two longitudinal edge zones and a plurality of fins each extending across the central zone and arranged side by side along the length of the central zone, alternate fins being located in two parallel planes to form two sets of fins, the thickness of the metal being substantially constant throughout the fin element, the fin elements being arranged between adjacent conduits with longitudinal ends of the fins extending into and forming intimate contracts with registering grooves in adjacent opposing surfaces of the conduits.

The spacing of the rectilinear grooves is preferably substantially twice the distance between the parallel planes of the two sets of fins of each fin element.

According to a further aspect of the invention there is provided a method of forming a fin element for a heat exchanger having a central longitudinal zone and two longitudinal edge zones from an elongate metallic strip having a mean plane comprising selectively pressing the strip across the central longitudinal zone in interspaced opposite directions to form alternative fins in two parallel planes at either side of the mean plane and arranging the thickness of the metal to be substantially constant in the finished element.

The method may include forming a plurality of parallel slits across the central longitudinal zone before selectively pressing the strip.

The step of arranging the thickness to be substantially constant may comprise allowing the overall width of the fin element to reduce while displacing the fins in opposite directions. The step of arranging the thickness to be substantially constant may comprise compressing the metal strip at least to some extent while displacing the fins in opposite directions.

The method may comprise displacing the strip into planes an equal distance from the original plane of the metallic.

The method may include displacing the fins to provide at the transverse ends of each fin a planar bridge portion, each of which bridge portions lie in a plane at an obtuse included angle with respect to a respect one of the parallel planes.

The method may comprise carrying out the steps of the method in one operation.

BRIEF DESCRIPTION OF THE DRAWINGS

A fin element and heat exchanger according to the invention will now be described by way of example with reference to the accompanying drawings in which.

DESCRIPTION OF A PREFERRED EMBODIMENT

Figure 1:
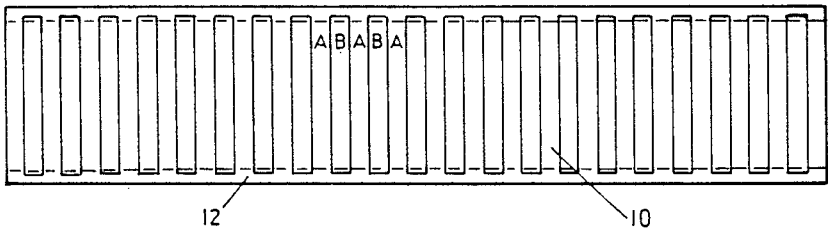
FIG. 1 is a plan view of a fin element.

The fin element shown in FIG. 1 is formed from a single elongate metal strip and has two sets of fins which alternate with one another. In the drawings one set of fins is labelled with the letter A, whilst the other set is labelled with the letter B. All the fins A lie in one plane, whilst all the fins B lie in another plane which is parallel to but spaced from the plane of fins A. Both planes are equidistant from and on opposite sides of a mean plane C (FIG. 2) of the fin element.

Figure 3:
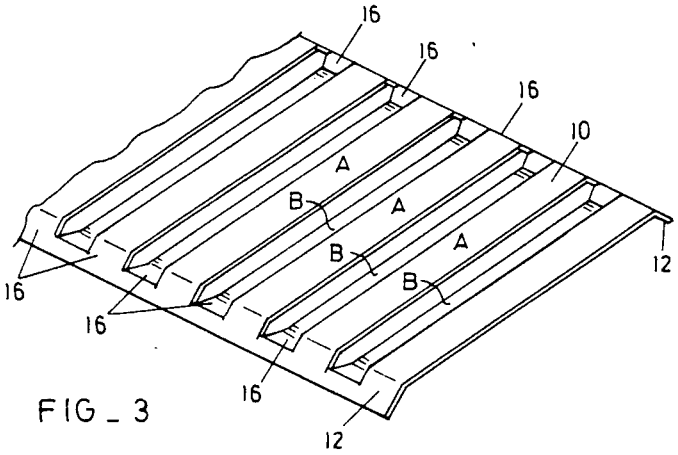
FIG. 3 is a perspective view on an enlarged scale of a portion of the fin element as shown in FIG. 1.

The fin element is also divided into a central longitudinal zone 10 and two edge zones 12. Each fin has a planar bridge portion 16 at each end. The three-dimensional form of the fin element can be seen from FIG. 3.

To manufacture the fin element, a flat strip of metal is used as starting material. The separate manufacturing steps which will now be described although they normally take place in a single operation.

Figure 4:
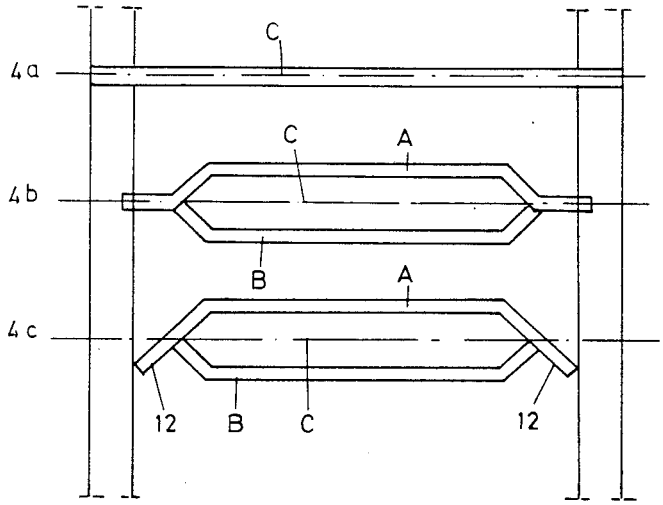
FIG. 4 illustrates schematically three major steps in manufacturing the fin element from a metal strip.

First of all, the strip is transversely slit over the central zone 10 to separate the metal which will form fins A and fins B. An even number of slits is made. Fins B are then pressed below the centre plane C, being the original plane of the strip, whilst fins A are pressed above the central plane C as shown in FIG. 4(*b*). The longitudinal edge zones 12 are bent over as shown out of the plane C to form an obtuse included angle with the planes of the fins A,B as shown in FIG. 4(*c*). This obtuse angle is ideally 135°.

In practice fin elements can be formed without a separate step of forming the slits. The strip is pressed selectively in interspaced opposite directions so that initial shearing of the strip is caused along the edges of the fins as the fins are pressed towards the respective parallel planes.

During the displacement of the fins the overall width of the strip is allowed to reduce as can be seen by comparing FIGS. 4(*b*) and 4(*c*) with FIG. 4(*a*). By allowing this reduction to occur no appreciable thinning of the fins A and B, the bridge portions 16 or the edge zones 12 takes place. Thus there is provided a finished fin element of substantially uniform metal thickness.

Figure 2:
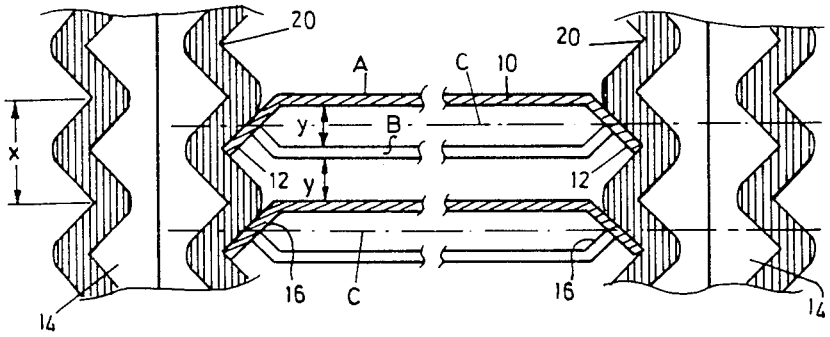
FIG. 2 is a section on an enlarged scale through a portion of a heat exchanger.

FIG. 2 shows a section of a heat exchanger between two conduits 14. As can be seen the conduits are corrugated, so that they have substantially rectilinear grooves 20 at regular intervals along their external surfaces. Again, as shown in FIG. 2, each fin element located is in one of these grooves 20 to form an intimate fit and provide intimate planar contact with the surface of corresponding grooves. The assembly is then hot dip galvanised so as to prevent corrosion and in order to thermally bond the contacts between the intimate co-operating surfaces so as to improve heat transfer.

The mean perpendicular distance y between the fins A and B is chosen to be half the distance x between adjacent grooves 20. In this way, the fins B of one element are also spaced a mean distance y from the fins A of an adjacent element, thus producing a substantially uniform fin configuration throughout the space between the two conduits 14.

Adjacent both ends of the fin element it is seen that all fins in each case are A fins. It could be arranged that all such fins were B fins. During assembly the fin elements are superimposed one above the other. Because all the end fins are either A fins or B fins there is no need to check the longitudinal orientation of each fin element prior to insertion into the heat exchanger. The symmetry of the fin elements ensures that the set of fins A in one fin element will register exactly with corresponding fin sets A of other fin elements, and the same will apply to the fin sets B.

An important improvement provided by embodiments of the present invention is that each fin element provided retains a uniform thickness of material throughout its configuration. This is achieved as explained above by allowing the overall width of the original strip of material to reduce during pressing to form the fins A and B. In earlier proposals pressing or otherwise forming the fin elements tended to cause thinning of the material at various places. Such thinning has the effect of disrupting and reducing the heat-flowing properties of the material which adversely affects the cooling characteristics of a heat exchange assembly incorporating fin elements provided in the prior art.

It will be noted that a finished fin element having uniform thickness can also be produced according to the invention by compressing the metal strip at least to some extent during the pressing to displace and form the fins into parallel planes.

Using the fin construction described in U.S. Pat. No. 4,332,291 it was necessary to insert two fin elements having alternative longitudinal orientation to provide the path for cooling air flow. The fin element described in U.S. Pat. No. 4,332,291 has fins in only one plane, as a result of this it can be difficult to obtain a close fin spacing between the conduits 14 without reducing the spacing between the grooves 20. It is difficult to reduce x because of the thickness of the walls of the conduits 14. Furthermore, in the fin elements described in U.S. Pat. No. 4,332,291 the fins are provided by punching out slots. The punched-out material therefore becomes scrap whereas in a fin element according to the present invention, no metal is removed and there is therefore no material waste.

Fin elements generally contribute approximately 60% of the cost of a typical heat exchanger assembly prior to galvanising for a dry-type cooling tower. The use of the improved fin elements of the present invention in a heat exchanger assembly has been shown to give a saving of as much as 52% on the cost of preparing and providing the fin elements for a heat exchanger. Further savings are made and security provided during assembly because longitudinal orientation of the fin elements is the same for each fin element.

I claim:

1. A heat exchanger which comprises spaced apart elongate conduits, each pair of opposed conduit surfaces carrying registering rows of grooves, and elongate fin elements locatable in the grooves by lengthwise sliding of the fin elements between the conduits, each fin element being formed from a single strip of metal to have a longitudinally extending central zone and two longitudinally extending edge zones and a plurality of fins which are spaced along the length of the fin element, which fins lie alternately in two parallel planes to form first and second fin sets, which extend across the central zone and which each have a planar bridge portion at either end, the longitudinal edge zones of the fin elements being inclined at an obtuse included angle with respect to the central zone and being coplanar with, and adjoining, the bridge portions of the first set of fins, the bridge portions of the two fin sets being orientated at an angle with respct to one another, and the grooves carried by the conduits being so deep relatively to the fin elements that not only the longitudinal edge zones, but also the bridge portions of the first set of fins, are in contact with the surfaces of the grooves.

2. A heat exchanger according to claim 1, in which the grooves are generally V-shaped, and the edge zones extend into the grooves to contact both surfaces thereof.

3. A heat exchanger according to claim 1, in which the thickness of the metal in each fin element is substantially constant throughout the fin element.

4. A heat exchanger according to claim 1 in which the spacing of the rectilinear grooves is substantially twice the distance between the parallel planes of the two sets of fins of each fin element.

* * * * *